US011344125B1

(12) United States Patent
Sun

(10) Patent No.: US 11,344,125 B1
(45) Date of Patent: May 31, 2022

(54) ROTARY HANGING CHAIR

(71) Applicant: Zhejiang Pride Leisure Products Co,. Ltd., Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 0 days.

(21) Appl. No.: 17/505,666

(22) Filed: Oct. 20, 2021

(30) Foreign Application Priority Data

Jun. 1, 2021 (CN) ..... 202110610306.9

(51) Int. Cl.

| | |
|---|---|
| ***A47C 3/18*** | (2006.01) |
| ***A47C 3/025*** | (2006.01) |
| ***A63G 9/14*** | (2006.01) |
| ***A63G 27/02*** | (2006.01) |
| ***A45F 3/24*** | (2006.01) |
| ***A45F 3/26*** | (2006.01) |
| ***A47C 4/02*** | (2006.01) |
| ***A47C 7/00*** | (2006.01) |
| ***A63G 9/12*** | (2006.01) |
| ***A63G 9/00*** | (2006.01) |
| ***A63G 9/04*** | (2006.01) |

(52) U.S. Cl.

CPC ..... *A47C 3/0255* (2013.01); *A45F 3/24* (2013.01); *A45F 3/26* (2013.01); *A47C 3/0252* (2013.01); *A47C 3/18* (2013.01); *A47C 4/028* (2013.01); *A47C 7/002* (2013.01); *A63G 9/00* (2013.01); *A63G 9/04* (2013.01); *A63G 9/12* (2013.01); *A63G 9/14* (2013.01); *A63G 27/02* (2013.01)

(58) Field of Classification Search

CPC ..... A47C 3/18; A47C 3/0255; A63G 9/00; A63G 9/04; A63G 9/12; A63G 27/02; A45F 3/24; A45F 3/26

USPC ..... 472/118, 119; 297/259.1, 273, 281, 297/344.1, 344.11, 344.21, 344.26

See application file for complete search history.

(56) References Cited

U.S. PATENT DOCUMENTS

| | | | | | |
|---|---|---|---|---|---|
| 563,894 | A * | 7/1896 | Thannheimer | A63G 27/02 | 472/30 |
| 801,046 | A * | 10/1905 | Porter | A63G 27/02 | 472/30 |
| 944,784 | A * | 12/1909 | Hand | A45F 3/24 | 5/129 |
| 1,142,970 | A * | 6/1915 | Koehler | A63G 1/12 | 472/20 |
| 3,130,969 | A * | 4/1964 | Groth | A63G 9/02 | 472/125 |

(Continued)

FOREIGN PATENT DOCUMENTS

| | | | |
|---|---|---|---|
| CN | 203028724 U | * | 7/2013 |
| CN | 107754318 A | * | 3/2018 |

(Continued)

*Primary Examiner* — Robert Canfield

(74) *Attorney, Agent, or Firm* — WPAT Law, P.C.; Anthony King

(57) ABSTRACT

A rotary hanging chair having a cushion assembly, a rotary assembly and a leg tube assembly. The cushion assembly is rotatably connected to the leg tube assembly by means of the rotary assembly and comprises a cushion and a support frame. Two sides of the cushion are detachably connected to the support frame. The cushion is able to swing with respect to the support frame.

19 Claims, 4 Drawing Sheets

(56) References Cited

U.S. PATENT DOCUMENTS

| | | | | | |
|---|---|---|---|---|---|
| 3,222,062 | A * | 12/1965 | Segna | A63G 1/20 | 472/20 |
| 3,480,973 | A * | 12/1969 | Stairs | A47K 3/282 | 4/567 |
| 4,417,725 | A * | 11/1983 | Van Horn | A63G 9/00 | 428/542.2 |
| 6,748,616 | B1 * | 6/2004 | Tseng | A45F 3/24 | 5/120 |
| 7,040,995 | B2 * | 5/2006 | Lee | A47C 3/0255 | 472/118 |
| 8,661,582 | B2 * | 3/2014 | Sclare | A47D 9/02 | 5/101 |
| 10,912,375 | B1 * | 2/2021 | Demin | A45F 3/24 | |
| 2006/0111194 | A1 * | 5/2006 | Dillner | A63G 9/16 | 472/119 |
| 2012/0178544 | A1 * | 7/2012 | Horst | A47D 13/105 | 472/118 |
| 2020/0367653 | A1 * | 11/2020 | Xuemin | A47C 5/02 | |
| 2021/0112954 | A1 * | 4/2021 | Gibson | A45F 3/24 | |

FOREIGN PATENT DOCUMENTS

| | | | | | |
|---|---|---|---|---|---|
| CN | 111760298 | A | * | 10/2020 | |
| GB | 186796 | A | * | 10/1922 | A63G 9/00 |
| GB | 2573018 | A | * | 10/2019 | A63G 9/16 |
| WO | WO-0182752 | A1 | * | 11/2001 | A47C 3/0255 |

* cited by examiner

ROTARY HANGING CHAIR

BACKGROUND OF THE INVENTION

1. Technical Field

The invention belongs to the technical field of chairs, and particularly relates to a novel rotary hanging chair.

2. Description of Related Art

Swing chairs are common leisure furniture in courtyards, gardens and amusement parks and are extremely popular in amusement parks because of their attractive appearance and romantic atmospheres created by them during use. When users sit on the swing chairs to rest in the shade, the swing chairs can by pushed to swing to bring a comfortable and cool feeling to users. Traditional swing chairs can only swing forwards and backwards like a swing and have a relatively constant angle that cannot be adjusted freely during use. In addition, existing swing chairs are provided with two symmetric supports, an adjustment device and a suspension rod are connected to the end of each support, and a shelter is assembled between the two adjustment devices. However, such swing chairs can only be used outdoors due to their large size. In addition, such swing chairs have a complicated structure, and it is difficult to assemble the ends of the supports, the adjustment devices, the suspension rods and the shelter together, which makes the swing chairs inconvenient to assemble and disassemble and makes it time-consuming and strenuous to assemble and dissemble such swing chairs. Besides, such swing chairs are inconvenient to use and difficult to carry.

Thus, it is necessary to improve the traditional swing chairs.

BRIEF SUMMARY OF THE INVENTION

The objective of the invention is to overcome the defects of the prior art by providing a novel rotary hanging chair, which is easy to assemble and disassemble, occupies a small space and allows the angle to be adjusted freely.

To fulfill the above objective, the invention adopts the following technical solution: a novel rotary hanging chair comprises a cushion assembly, a rotary assembly and a leg tube assembly, wherein the cushion assembly is rotatably connected to the leg tube assembly by means of the rotary assembly; the cushion assembly comprises a cushion and a support frame, two sides of the cushion are detachably connected to the support frame, and the cushion is able to swing with respect to the support frame. The chair assembly of the rotary hanging chair is able to rotate with respect to the leg tube assembly, so that users can adjust the angle of the cushion by rotating the cushion; and the cushion is able to swing to be used as a swing, so that users feel comfortable and have a good rest on the rotary hanging chair.

Further, the support frame comprises vertical support tubes, a horizontal support tube, support tube connecting seats and a rope, wherein the two vertical support tubes are connected to two ends of the horizontal support tube by means of the two support tube connecting seats respectively, the rope has an end connected to one cushion retaining bracket, as well as an end sequentially penetrating through one vertical support tube, one support tube connecting seat, the horizontal support tube, the other support tube connecting seat and the other vertical support tube to be connected to the other cushion retaining bracket, and the two sides of the cushion are detachably connected to the two cushion retaining brackets, respectively. The rotary hanging chair can be assembled merely by means of the vertical support tubes and the horizontal support tube, thus being simpler in structure and easier to carry compared with traditional swing chairs.

Further, suspension straps on the two sides of the cushion are disposed around upper ends of the cushion retaining brackets.

Further, the support tube connecting seats are formed with through holes, and the horizontal support tube and the vertical support tubes are connected to the support tube connecting seats.

Further, the vertical support tubes are circular tubes, and the horizontal support tube is a square tube.

Further, the rotary assembly comprises a rotary upper cover, steel balls, a rotary lower cover and a rivet, wherein the rotary upper cover and the rotary lower cover clamp the steel balls and are then connected into a whole by means of the rivet, so that the rotary upper cover is able to roll with the rivet as an axis by means of the steel balls to rotate with respect to the rotary lower cover.

Further, a support block is disposed in the middle of the horizontal support tube and is detachably connected to the rotary upper cover.

Further, the rotary assembly further comprises a decorative cover, and the decorative cover is formed with a groove for clamping the horizontal support tube and covers the support block.

Further, the leg tube assembly comprises a leg tube connecting seat, leg tubes, leg sleeves and two leg tube tension ropes, wherein the two leg tube tension ropes vertically stretch into the leg tube connecting seat, then stretch out of four leg tube holes of the leg tube connecting seat, and finally penetrate through the four leg tubes to be fixed in the four leg sleeve; two ends of the leg tubes are assembled with the leg tube holes and the leg tubes respectively; and the leg tube connecting seat is detachably connected to the rotary assembly.

Further, the leg tubes are square tubes.

Further, anti-skid grooves are formed in bottoms of the leg sleeves.

By the adoption of the technical solution, the invention has the following beneficial effects: the rotary hanging chair has the advantages of being simple in structure, low in weight, easy to use and comfortable, occupies a small space, and is suitable for many indoor and outdoor occasions; the cushion is able to swing, so that the usage experience and comfort of users are improved; a detachable design is adopted, so that the rotary hanging chair can be assembled and disassembled rapidly, and is convenient to carry, capable of rotating freely within 360°, and high in flexibility.

In the figures: 1, cushion; 2, cushion retaining bracket; 3, rope; 4, vertical support tube; 5, decorative cover; 6, horizontal support tube; 7, support tube connecting seat; 8, rivet;

9, rotary upper cover; 10, steel ball; 11, rotary lower cover; 12, leg tube connecting seat; 13, leg tube; 14, leg sleeve; 15, leg tube tension rope.

DETAILED DESCRIPTION OF THE INVENTION

To gain a better understanding of the technical solution of the invention, the specific embodiments of the specific solution of the invention will be further expounded below in conjunction with the accompanying drawings.

Figure 1:
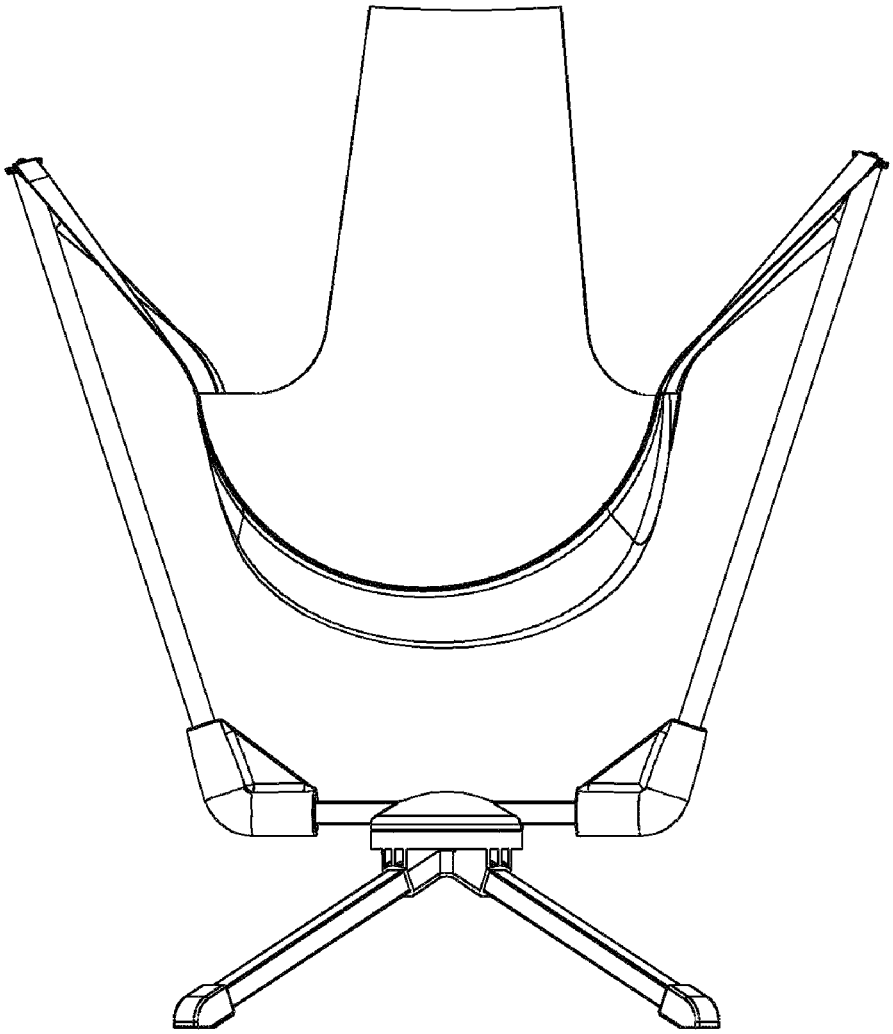
FIG. 1 is a front view of a novel rotary hanging chair.
Figure 2:
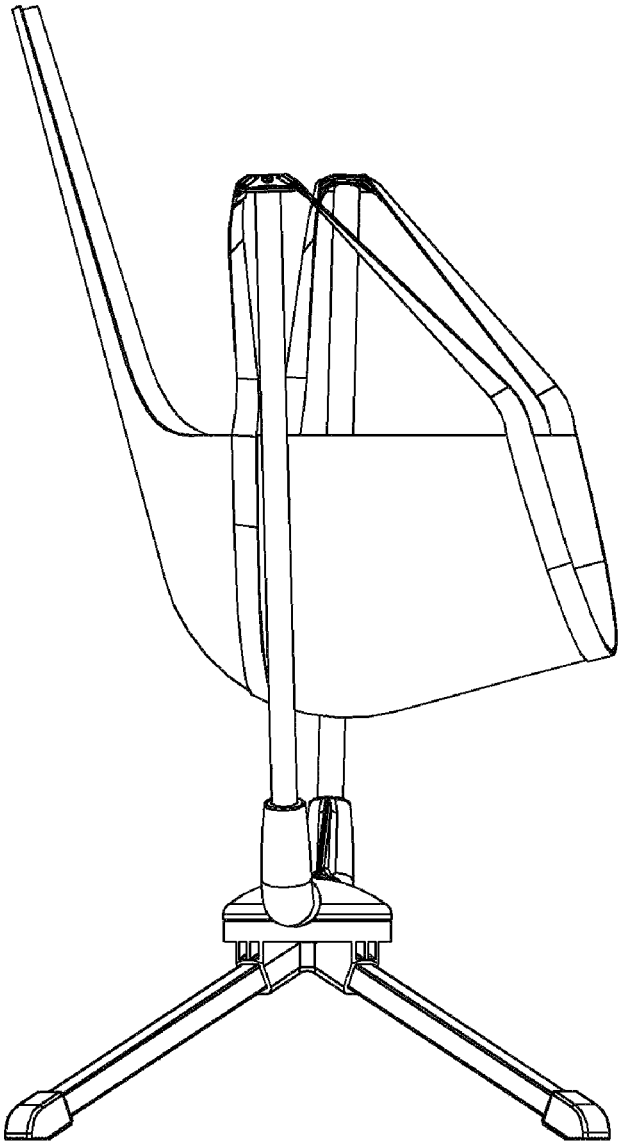
FIG. 2 is a side view of the novel rotary hanging chair.
Figure 3:
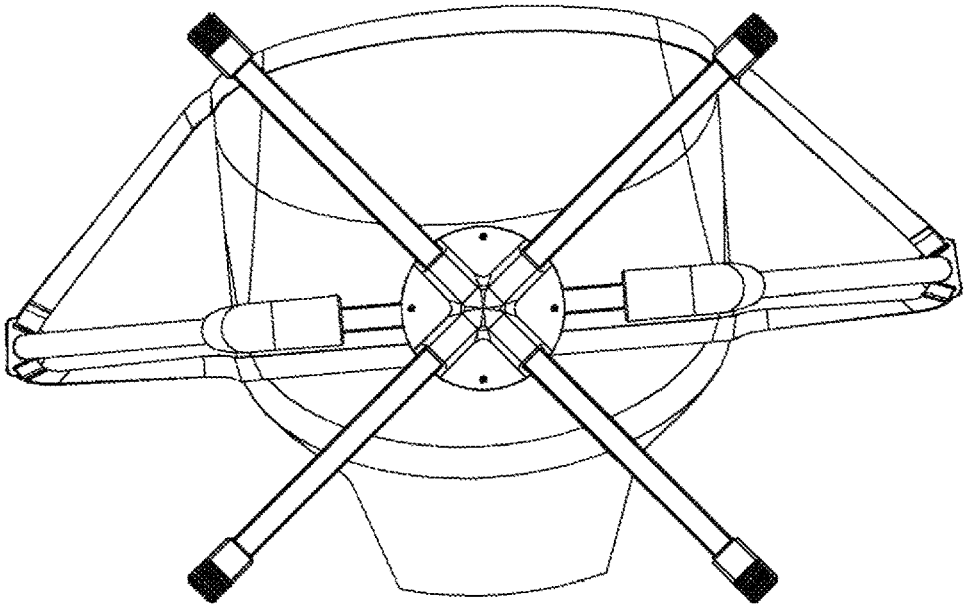
FIG. 3 is a bottom view of the novel rotary hanging chair.
Figure 4:
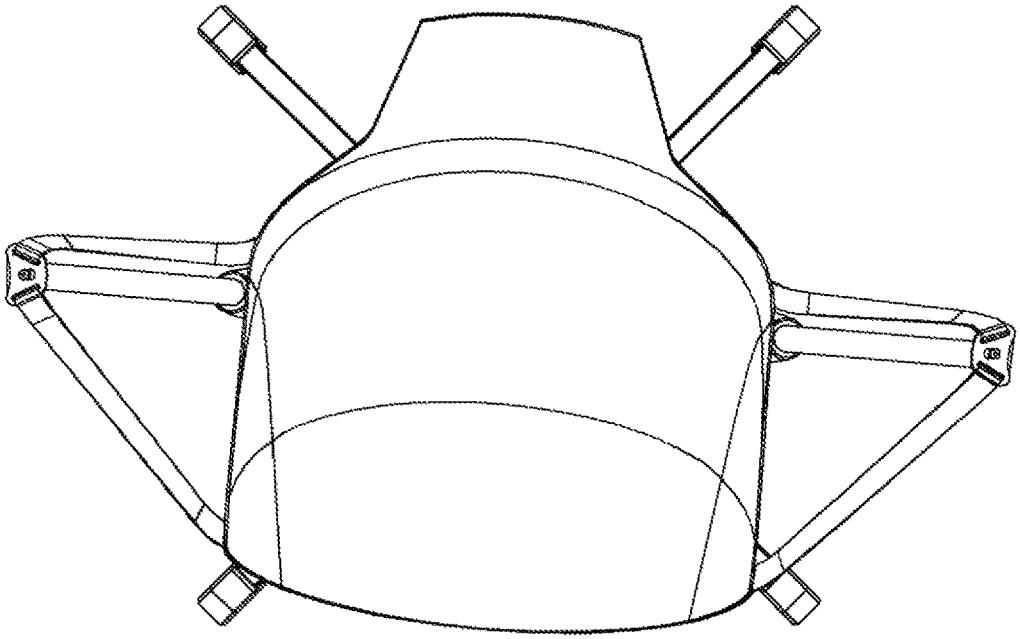
FIG. 4 is a top view of the novel rotary hanging chair.
Figure 5:
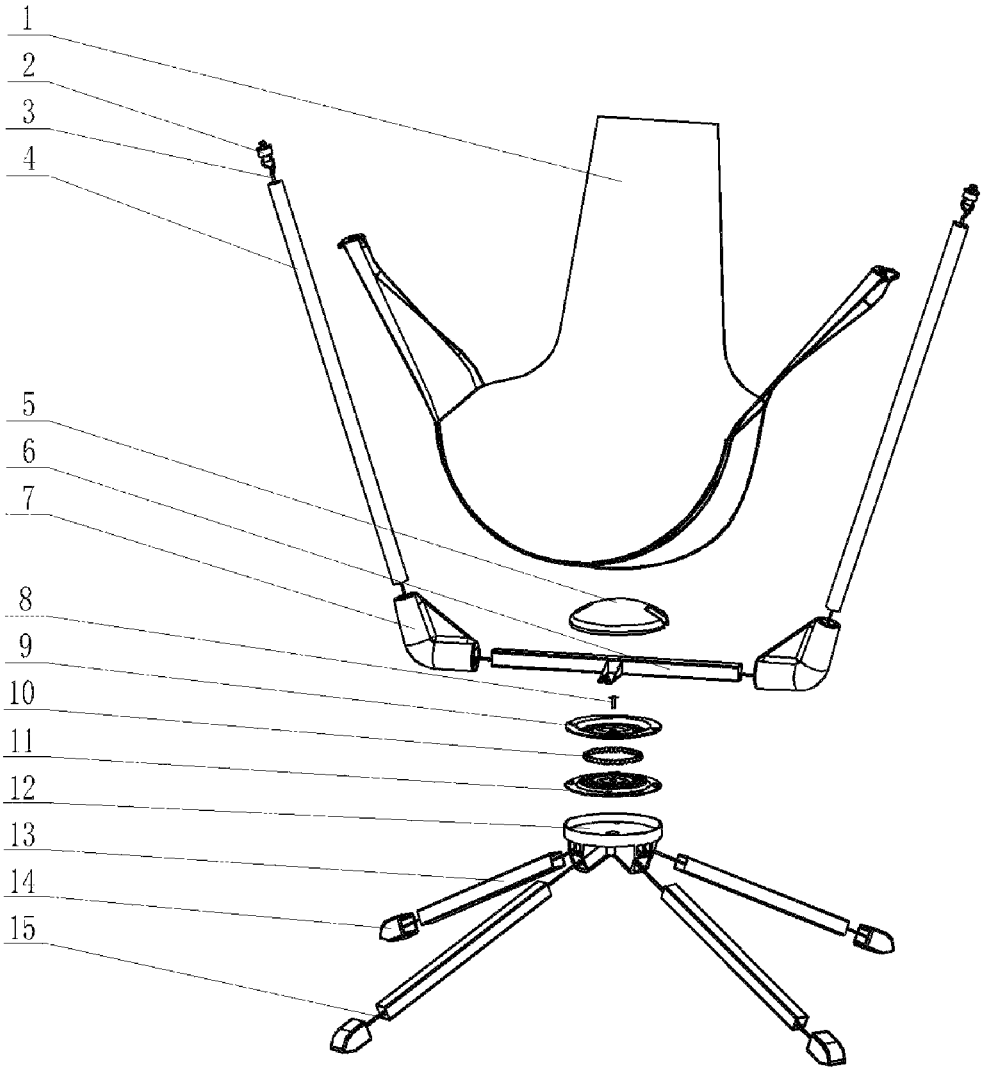
FIG. 5 is a structural view of the novel rotary hanging chair.

As shown in FIG. 1-FIG. 5, this embodiment discloses a novel rotary hanging chair which comprises a cushion assembly, a rotary assembly and a leg tube assembly. The cushion assembly is rotatably connected to the leg tube assembly by means of the rotary assembly. Wherein, the cushion assembly is composed of a cushion 1, two cushion retaining brackets 2, two vertical support tubes 4, a horizontal support tube 6, two support tube connecting seats 7 and a rope 3, wherein the two cushion retaining brackets 2, the two vertical support tubes 4, the horizontal support tube 6, the two support tube connecting seats 7 and the rope 3 form a support frame for mounting the cushion 1. The rotary assembly is composed of decorative cover 5, a rivet 8, a rotary upper cover 9, a set of steel balls 10 and a rotary lower cover 11. The leg tube assembly is composed of a leg tube connecting seat 12, four leg tubes 13, four leg sleeves 14 and two leg tube tension ropes 15.

According to the cushion assembly in this embodiment, the two vertical support tubes 4 are connected to two ends of the horizontal support tube 6 by means of the two support tube connecting seats 7 respectively, one end of the rope 3 is connected to one cushion retaining bracket 2, the other end of the rope 3 sequentially penetrates through one vertical support tube 4, one support tube connecting seat 7, the horizontal support tube 6, the other support tube connecting seat 7 and the other vertical support tube 4 to be connected to the other cushion retaining bracket 2, and two sides of the cushion 1 are detachably connected to the two cushion retaining brackets 2 respectively. Suspension straps on the two sides of the cushion 1 are disposed around upper ends of the cushion retaining brackets 2. The support tube connecting seats 7 are formed with through holes, and the horizontal support tube 6 and the vertical support tubes 4 are connected to the support tube connecting seats 7. Specifically, according to the cushion assembly, one end of the rope 3 is tied to the bottom of one cushion retaining bracket 2, and the other end of the rope 3 sequentially penetrates through one vertical support tube 4, one support tube connecting seat 7, the horizontal support tube 6, the other support tube connecting seat 7 and the other vertical support tube 4 to be tied to the bottom of the other cushion retaining bracket 2. The two cushion retaining brackets 2 are inlaid in the two vertical support tubes 4 respectively to form a cushion support structure together with the vertical support tubes 4 inserted into the two support tube connecting seats 7 as well as the horizontal support tube 6. The two suspension straps of the cushion 1 are disposed around the cushion retaining brackets 2 respectively to form the cushion assembly.

In a preferred embodiment, the vertical support tubes 4 are circuit tubes, and the horizontal support tube 6 is a square tube. The cushion 1 is made of a flexible material such as fabric that is able to warp other parts when the rotary hanging chair 1 is disassembled.

According to the rotary assembly in this embodiment, the rotary upper cover 9 and the rotary lower cover 11 clamp the steel balls 10 and are then connected to the horizontal support tube 6 in the middle by means of the rivet 8, so that the rotary upper cover 9 is able to rotate with respect to the rotary lower cover 11 with the rivet 8 as an axis. A support block is disposed in the middle of the horizontal support tube 6 and is detachably connected to the rotary upper cover 9. The decorative cover 5 is formed with a groove for clamping the horizontal support tube 6 and covers the support block. Specifically, the rotary upper cover 9, the rotary lower cover 11, and the set of steel balls 10 clamped between the rotary upper cover 9 and the rotary lower cover 11 are riveted together by means of the rivet 8, so that the rotary upper cover 9 is able to rotate with respect to the rotary lower cover 11 around the rivet 8.

According to the leg tube assembly in this embodiment, the two leg tube tension ropes 15 vertically stretch into the leg tube connecting seat 12, then stretch out of four leg tube holes of the leg tube connecting seat 12, and finally penetrate through the four leg tubes 13 to be fixed in the four leg sleeves 14, and two ends of the leg tubes 13 are assembled with the leg tube holes and the leg tubes 14 respectively; and the leg tube connecting seat 12 is detachably connected to the rotary assembly. Specifically, according to the leg tube assembly, the two leg tube tension ropes 15 vertically stretch into the leg tube connecting seat 12, then stretch out of the four leg tube holes, and finally penetrate through the four leg tubes 13 to be tied in the four leg sleeves 14. Then, the leg sleeves 14 are knocked into the leg tubes 13 and are inserted into the leg tube connecting seat 12.

In this embodiment, the leg tube connecting seat 12 of the leg tube assembly is connected to the rotary lower cover 11 of the rotary assembly by means of screws; and the horizontal support tube 6 (to be specific, the support block) of the cushion assembly is connected to the rotary upper cover 9 of the rotary assembly by means of screws and is decorated and covered by the decorative cover 5.

In a preferred embodiment, the leg tubes 13 are square tubes.

In a preferred embodiment, anti-skid grooves are formed in bottoms of the leg sleeves 14.

The usage and assembly/disassembly principle of the novel rotary hanging chair in this embodiment is as follows:

(1) When the novel rotary hanging chair is to be unfolded, the vertical support tubes 4 and the horizontal support tube 6 are sequentially inserted into the support tube connecting seats 7 in the direction of the rope 3; then, the two suspension straps of the cushion 1 are disposed around the two cushion retaining brackets 2 respectively; after that, the leg tubes 13 are inserted into the leg tube connecting seat 12 to support the whole rotary hanging chair. When the novel rotary hanging chair is used, users sit on the cushion 1 with their feet off the ground, and then the rotary hanging chair is able to swing forwards and backwards like a swing; and when the users thrust against the ground leftwards and rightwards with their feet, the rotary handing chair is able to rotate in the same place.

(2) When the novel rotary hanging chair is to be folded, the cushion 1 is disassembled from the cushion retaining brackets 2 at first; then, the vertical support tubes 4 and the horizontal support tube 6 are pulled out of the support tube connecting seats 7 to be kept in parallel with the horizontal support tube 6; after that, the four leg tubes 13 are pulled out of the leg tube connecting seat 12 to be kept in parallel with the horizontal support tube 6; and finally, other parts are wrapped with the cushion 1 to be stored in a bag.

It should be noted that the aforesaid description is merely used to explain the preferred embodiments and technical principle of the invention. Those skilled in the art would appreciate that the invention is not limited to the specific embodiments described here, and various obvious transformations, adjustments and substitutions can be made by those skilled in the art without departing from the protection scope of the invention. So, although the invention has been described in detail with reference to the above embodiments, the invention is not limited to these embodiments and may include more other equivalent embodiments without departing from the concept of the invention, and the scope of the invention is subject to the scope of the claims.

What is claimed is:

1. A rotary hanging chair, comprising a cushion assembly, a rotary assembly and a leg tube assembly, wherein the cushion assembly is rotatably connected to the leg tube assembly by means of the rotary assembly;

the cushion assembly comprises a cushion and a support frame, two sides of the cushion are detachably connected to the support frame, and the cushion is able to swing with respect to the support frame;

wherein the support frame comprises vertical support tubes, a horizontal support tube, support tube connecting seats and a rope, the two vertical support tubes are connected to two ends of the horizontal support tube by means of the two support tube connecting seats respectively, the rope has an end connected to a cushion retaining bracket, as well as an end sequentially penetrating through one said vertical support tube, one said support tube connecting seat, the horizontal support tube, the other support tube connecting seat and the other vertical support tube to be connected to another cushion retaining bracket, and the two sides of the cushion are detachably connected to the two cushion retaining brackets, respectively.

2. The rotary hanging chair according to claim 1, wherein suspension straps are arranged on the two sides of the cushion and are disposed around upper ends of the cushion retaining brackets.

3. The rotary hanging chair according to claim 1, wherein the support tube connecting seats are formed with through holes, and the horizontal support tube and the vertical support tubes are connected to the support tube connecting seats.

4. The rotary hanging chair according to claim 1, wherein a cross-section of the vertical support tubes and a cross-section of the horizontal support tube are of any shapes.

5. The rotary hanging chair according to claim 1, wherein the rotary assembly comprises a rotary upper cover, steel balls, a rotary lower cover and a rivet, the rotary upper cover and the rotary lower cover clamp the steel balls and are then connected into a whole by means of the rivet, so that the rotary upper cover is able to roll with the rivet as an axis by means of the steel balls to rotate with respect to the rotary lower cover.

6. The rotary hanging chair according to claim 5, wherein a support block is disposed in a middle of the horizontal support tube and is detachably connected to the rotary upper cover.

7. The rotary hanging chair according to claim 5, wherein the rotary assembly further comprises a decorative cover, and the decorative cover is formed with a groove for clamping the horizontal support tube and covers the support block.

8. The rotary hanging chair according to claim 1, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

9. The rotary hanging chair according to claim 2, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

10. The rotary hanging chair according to claim 3, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

11. The rotary hanging chair according to claim 4, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

12. The rotary hanging chair according to claim 5, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

13. The rotary hanging chair according to claim 6, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

14. The rotary hanging chair according to claim 7, wherein the leg tube assembly comprises a leg tube connecting seat, leg tubes, leg sleeves and two leg tube tension ropes, and the two leg tube tension ropes vertically stretch into the leg tube connecting seat, then stretch out of four leg tube holes of the leg tube connecting seat, and finally penetrate through the four leg tubes to be fixed in the four leg sleeves; two ends of the leg tubes are assembled with the leg tube holes and the leg tubes respectively; and the leg tube connecting seat is detachably connected to the rotary assembly.

15. The rotary hanging chair according to claim 8, wherein anti-skid grooves are formed in bottoms of the leg sleeves.

16. The rotary hanging chair according to claim 9, wherein anti-skid grooves are formed in bottoms of the leg sleeves.

17. The rotary hanging chair according to claim 10, wherein anti-skid grooves are formed in bottoms of the leg sleeves.

18. The rotary hanging chair according to claim 11, wherein anti-skid grooves are formed in bottoms of the leg sleeves.

19. The rotary hanging chair according to claim 12, wherein anti-skid grooves are formed in bottoms of the leg sleeves.

* * * * *